United States Patent [19]

Quenzi et al.

[11] Patent Number: 4,978,246

[45] Date of Patent: Dec. 18, 1990

[54] APPARATUS AND METHOD FOR CONTROLLING LASER GUIDED MACHINES

[76] Inventors: Philip J. Quenzi, Rte. 1, Box 56A, Atlantic Mine, Mich. 49905; David W. Somero, Wheeler Rd., New Ipswich, N.H. 03071

[21] Appl. No.: 381,177

[22] Filed: Jul. 18, 1989

[51] Int. Cl.[5] ..... E01C 19/22; E01C 23/01; G01C 9/06

[52] U.S. Cl. ..... 404/84; 404/118; 33/DIG. 21; 172/4.5; 356/152

[58] Field of Search ..... 404/118, 75, 84; 33/227, 228, DIG. 21; 172/4, 4.5; 264/31, 293, 310; 356/138, 152; 37/DIG. 20

[56] References Cited

U.S. PATENT DOCUMENTS

| | | | |
|---|---|---|---|
| 3,069,983 | 12/1962 | Pizzarotti et al. | 172/4.5 |
| 3,873,226 | 3/1975 | Teach | 404/84 |
| 3,887,012 | 6/1975 | Scholl et al. | 356/138 |
| 3,953,145 | 4/1976 | Teach | 172/4.5 |
| 4,162,708 | 7/1979 | Johnson | 172/4.5 |
| 4,273,196 | 6/1981 | Etsusaki et al. | 172/4.5 |
| 4,371,287 | 2/1983 | Johansson | 404/84 |
| 4,655,633 | 4/1987 | Somero et al. | 404/84 |

OTHER PUBLICATIONS

Drawing No. 1HI-1999, entitled "Current Laser Machine Control Circuit", showing hydraulic electric control circuit for laser screeding apparatus of the type shown in U.S. patent application Ser. No. 07/291,678, filed Dec. 29, 1988.

*Primary Examiner*—Bruce M. Kisliuk

*Attorney, Agent, or Firm*—Price, Heneveld, Cooper, DeWitt & Litton

[57] ABSTRACT

A guidance system and method for increasing the accuracy of laser guided machines such as screeds, graders, earth movers, floor saws and floor finishing machines. The system includes a laser beam receiver for sensing a laser reference beam provided off the machine. The laser receiver signals an electrical circuit when the laser beam is sensed in both centered and off-center regions. The electrical circuit operates a controller such as a solenoid operated fluid valve which controls a power source such as a fluid cylinder to move a machine element in one direction, such as raising a concrete screed, when the beam is sensed in the centered region, and in the other direction, such as lowering the screed, when the beam is sensed off-center. The method includes controlling the power source to continuously cycle the machine element between centered and off-centered regions to reduce the dead band, i.e., nonactive tolerance range, of the system.

35 Claims, 4 Drawing Sheets

APPARATUS AND METHOD FOR CONTROLLING LASER GUIDED MACHINES

BACKGROUND OF THE INVENTION

This invention relates to machines which are guided in their operation by laser responsive guidance/control systems and, more particularly, to an apparatus and method for accurately controlling laser guided machines such as concrete screeding apparatus, earth movers and graders, floor cutting saws, floor finishing machines and the like.

Recent years have witnessed the increasing use of laser beam guidance/control systems on various types of machines. Typically, a rotating laser beacon or projector is positioned externally of a machine such as a grader or concrete screed such that the rotating beacon of the projector creates a precisely located plane of laser light in the area surrounding the rotating beacon. A machine to be guided by the laser plane includes one or more laser beam receivers which generate electrical signals when the machine or machine element on which the receiver is mounted is off-center from the laser beam, i.e., high, low, left or right of the laser plane. In one presently existing system, electrical signals from the laser beam receiver are processed through an electrical control circuit which is connected to appropriate valving to operate fluid cylinders which move the machine element in a defined direction relative to the sensed laser beam.

A principal reason for use of laser guidance on machines is to increase the accuracy of the resultant work product such as the area being graded or the concrete being finished. However, experience with existing systems has shown that the accuracy of the system depends on the accuracy of the laser beam receiver and the inherent "dead band" which exists when the laser receiver is centered "on target" with the laser beam. For example, in the existing system mentioned above, because of the width of the laser reference beam, the "on target" or "dead band" range is one-half to three-quarters of an inch. This means that the greatest accuracy obtainable with the system is plus or minus one-quarter to three-eighths of an inch. In many situations, such tolerances are simply too great as in, for example, finishing concrete where accuracy in height of the concrete of one-sixteenth to one-eighth of an inch is required.

In an effort to overcome the above laser guidance tolerance and accuracy deficiencies, especially in laser guided concrete screeds or finishing machines, previous methods have included adjusting the physical position of the machine with respect to the laser plane in order to reduce the dimension of the "on target" range or dead band. For example, with the laser guided screeding machine shown in FIG. 3 herein, and disclosed in co-pending U.S. patent application Ser. No. 07/291,678, filed Dec. 29, 1988 entitled IMPROVED SCREEDING APPARATUS AND METHOD, the screeding machine is positioned with its screed support boom at an approximate 2% slope such that its free end is lower than the supported base end. As the screed assembly is operated and moved toward the base of the machine to finish the poured concrete, it steadily rises due to the sloped position of the boom. As a result, if the screed assembly begins "on target" such that the laser receiver is centered with respect to the laser plane, it will rise to the "high" range above the "on target" range in a short distance. The control valving will then lower it back to the "on target" position. This pattern will repeat and provide a saw tooth pattern with an approximate one-eighth inch amplitude without traversing the wider dead band normally associated with laser receivers and without ever operating in the low range. This setup method is referred to as working off the "top edge of the laser beam".

However, working off the top edge of the laser beam requires precise positioning of the machine each time the machine is set up to finish an area of concrete. In a typical day, such machine may be moved and positioned as many as one hundred times. The additional positioning of the boom at a 2% slope adds a significant time factor to the finishing operation thereby increasing the cost of finishing the concrete. In certain situations, positioning of the machine at the 2% slope is also quite difficult. Further, in some situations, it is not possible to create the 2% slope such as when the screeding machine is being moved while finishing concrete behind the machine. In other machines, such as earth movers and graders not having cantilevered booms like the screed, there is no appropriate method for physically creating a slope on which the machine can operate. Hence, use of an artificial physical setup as a means for overcoming the above tolerance and accuracy problems is impossible.

Accordingly, a need was apparent for an apparatus and method suitable for controlling laser guided machines which would provide and maintain greater accuracy in the work product resulting from such machines and allow use on a wider range of machines including those being moved while operating.

SUMMARY OF THE INVENTION

The present invention provides a guidance system and method for increasing the accuracy of a laser guided machine of the type including a movable machine element which is positioned in response and relative to a laser reference beam located externally of the machine. In one form, the guidance system includes a laser beam receiving means mounted on and movable with the machine element for sensing the laser reference beam in a first centered region and in a second off-center region. Electrical circuit means are connected electrically to the laser beam receiving means for providing a first electrical condition when the machine element and the laser beam receiving means are in the first centered region and a second electrical condition when the machine element and laser beam receiving means are in the second off-center region. Motive power means are included for moving the machine element and laser beam receiving means in at least two directions between the first region and second region. Control means connected electrically to the electrical circuit means and mounted on the machine are included for operating the motive power means in response to the electrical circuit means to move the machine element in a first of two directions from the first region to the second region when the electrical circuit means provides the first condition. The control means operate the motive power means to move the machine element and the laser beam receiving means in the second of the two directions from the second region back to the first region when the electrical circuit means provides the second condition. Thus, the machine will continuously cycle between the first and second regions while reducing the tolerance area or dead band of the system.

Preferably, the motive power means is a fluid cylinder although electric motors operating cams or clutches or other power sources such as internal combustion engines can be utilized. In one form, the control means is a solenoid operated fluid valve for directing fluid to and from the fluid cylinder and is controlled by the electric circuit means. Preferably, when the laser beam receiving means is centered on the laser reference beam, the solenoid operated fluid valve is normally open and causes the fluid cylinder to move the machine element and laser beam receiving means in one direction such as to raise a screed assembly on a concrete screeding apparatus. When the machine element reaches the off-center second region, the electrical circuit means operates the solenoid valve in response to the laser beam receiving means to change the valve position and move the fluid cylinder in the opposite direction to return the machine element such as the screed to its first position. The cycle continues and repeats itself thereby reducing the tolerance limits and dead band of the system.

In other aspects of the system, the laser beam receiving means may include a pair of photosensors which generate electrical energy to activate the electrical circuit means depending on their position relative to the sensed laser beam. Further, the electrically operated fluid valves may include two sets of valve ports which are alternately opened and closed to control the fluid cylinder.

The invention also includes a method for increasing the accuracy of and controlling a laser guided machine relative to a laser reference beam located externally of a machine. The method includes sensing the laser reference beam with a laser beam receiver on the machine element when the laser beam receiver is in a first centered region with respect to the laser reference beam and in a second off-center region. A first electrical condition is provided with an electrical circuit means connected to the laser beam receiver on the machine when the machine element and laser beam receiver are in the first centered region. A second electrical condition is provided with the electrical circuit means when the machine element and laser beam receiver are in the second off-center region. The method further includes controlling a motive power means to move the machine element and laser beam receiver in a first of two directions from the first region to the second region in response to the first electrical condition, and in the second of said two directions from the second region back to the first region in response to the second electrical condition. Thus, the machine element is continuously cycled between the first and second regions to reduce the dead band of the system. As with the apparatus, the preferred method is used to control one of various machines such as a screeding apparatus for finishing concrete.

The improved guidance system and method provide significant advantages over current laser guided machine controls. First, the accuracy of the guided machines is greatly increased, for example by reducing the dead band experienced with a conventional system by 50% or more. The system and method avoid the necessity of time consuming, physically sloped setups for machines such as concrete screeding apparatus each time the machine is moved from place to place. In addition, the invention provides increased accuracy for use on machines that must be guided while in motion such as with graders or earth movers or with screeding apparatus which may be driven through poured concrete to finish the concrete in the area behind the machine while it is moving. Likewise, the invention has applications on other machines where physical setup in a sloped arrangement is not possible.

These and other objects, advantages, purposes and features of the invention will become more apparent from a study of the following description taken in conjunction with the drawings.

DESCRIPTION OF THE PREFERRED EMBODIMENTS

Figure 1:
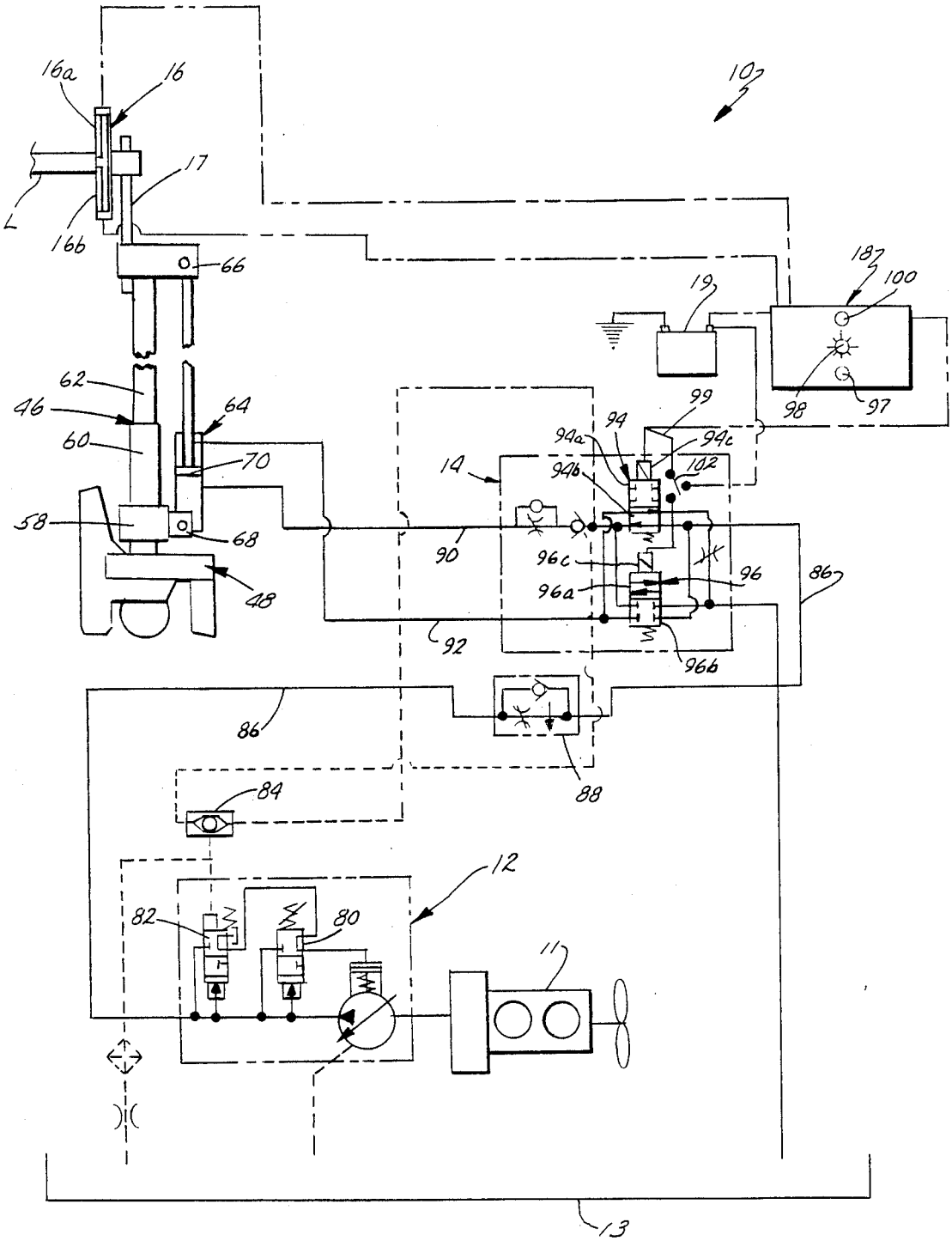
FIG. 1 is a schematic illustration of a hydraulic/electrical guidance system incorporating the present invention and shown in its centered, "on target" condition, which system is adapted for use with an apparatus for screeding uncured concrete and like materials.
Figure 2:
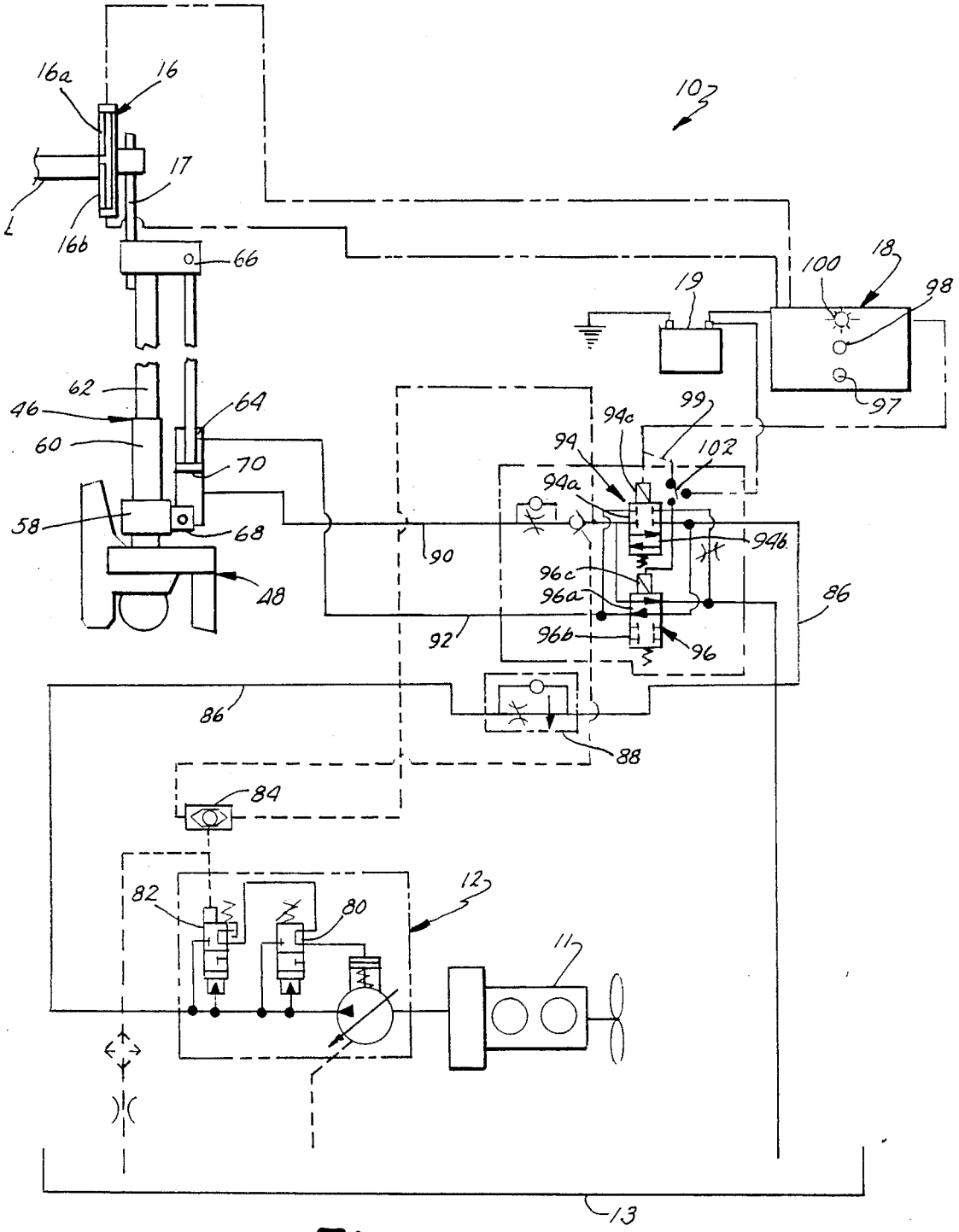
FIG. 2 is a schematic illustration of the hydraulic-/electrical guidance system for a screeding apparatus of FIG. 1 but shown in a second off-center, high condition.
Figure 3:
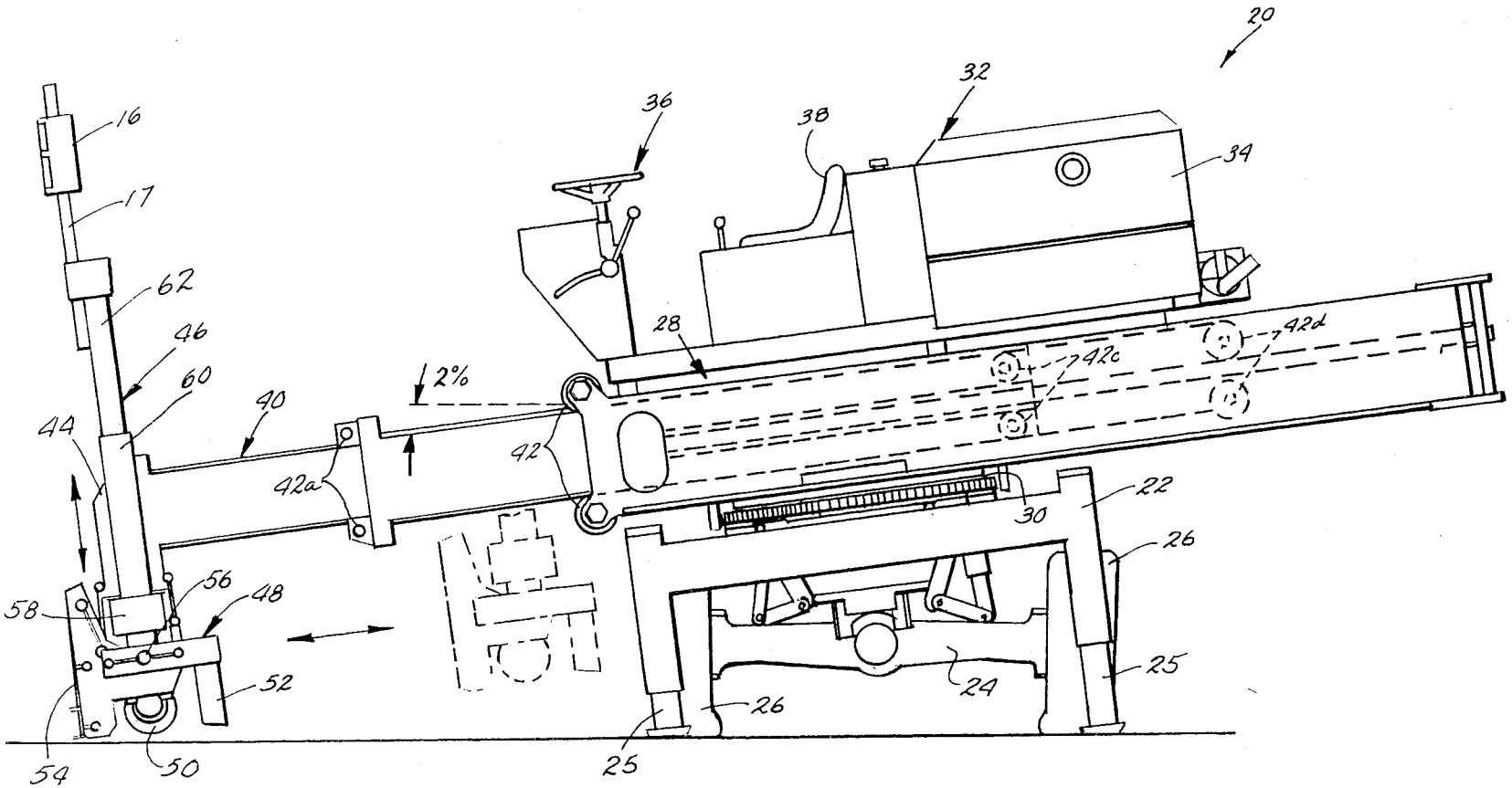
PRIOR ART Fig. 3.
FIG. 3 is a front elevation of a concrete screeding apparatus of the type useful with the present invention and illustrated in a sloped setup position used prior to the incorporation of the present invention.
Figure 4:
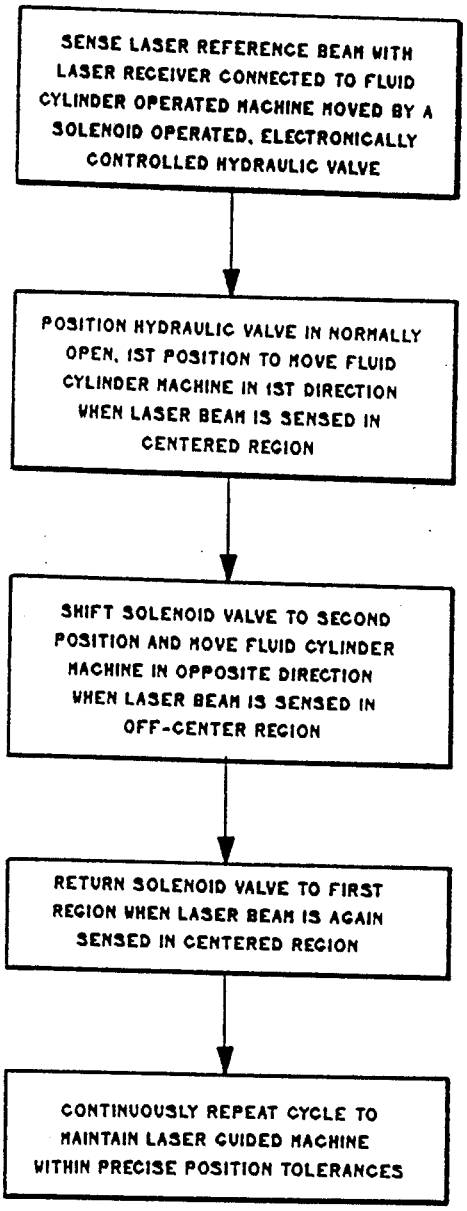
FIG. 4 is a schematic diagram of the preferred method of controlling a laser guided machine which incorporates a fluid cylinder and a solenoid operated, electrically controlled, hydraulic fluid valve.

Referring now to the drawings in greater detail, FIGS. 1 and 2 illustrate a preferred form 10 of the guidance system of the present invention adapted to increase the accuracy of a laser guided machine such as a concrete screeding apparatus of the type shown in FIG. 3. Guidance system 10 is a hydraulic/electric control system including a hydraulic pump 12 providing pressurized hydraulic fluid controlled by electrically operated, solenoid-type, hydraulic fluid valve assembly 14 to a motive power source such as fluid cylinder 64. Cylinder 64 is adapted to raise and lower a machine element such as concrete screed assembly 48 to engage, spread and smooth uncured concrete over large areas to a precise level preferably within a tolerance range of one-sixteenth to one-eighth inch. The vertically movable screed assembly 48 carries a laser beam receiver 16 which senses laser reference plane or beam L (shown in exaggerated size for clarity) and generates electrical signals which are coupled to appropriate electrical circuitry in an electrical control 18. Electrical circuit 18 is, in turn, connected to electrically operated fluid valve assembly 14 to control the raising, lowering and, thus, the vertical position of screed assembly 48 and laser beam receiver 16 in response to the sensed laser reference plane or beam.

Guidance system 10 is especially useful with a screeding apparatus 20 (FIG. 3) which is disclosed in co-pending U.S. patent application Ser. No. 07/291,678, filed Dec. 29, 1988, entitled IMPROVED SCREEDING APPARATUS AND METHOD, and invented by Philip J. Quenzi, David W. Somero and Paul J. Somero. Screeding apparatus 20 is a self-propelled machine designed for finishing poured, uncured concrete or other like loose or plastic materials in both restricted or open areas, but is particularly advantageous in areas in which it is inconvenient to lay support rails or guides and/or position large, rail supported screeds or slip form pavers.

Screeding machine 20 includes a lower support frame 22 having a pair of pivotable, front and rear propulsion support axles 24 each of which provides both propulsion and steering capability. Four support wheels 26, preferably including rubber tires, are rotatably supported at the ends of the axles 24. An upper frame or platform 28 is rotatably mounted on a circular bearing 30 and includes an operator support platform 32 on which an engine/hydraulic pump compartment 34 is mounted. An internal combustion engine 11 (FIGS. 1 and 2) and hydraulic pump 12 are mounted in compartment 34. Appropriate machine controls 36, including a tiltable steering console, are located at the front of platform 28 for use by an operator when seated in seat 38. Platform 28 also provides support for telescoping boom assembly 40.

Boom assembly 40 extends outwardly from upper frame 28 below operator platform 32 and is mounted for horizontal, telescoping extension and retraction on suitable bearings 42*a*, 42*b*, 42*c* and 42*d* by means of a fluid cylinder (not shown). On the outer, free end of boom assembly 40 is a screed mounting assembly 44 to which screed elevation assembly 46 is attached. A screed assembly 48 is, in turn, mounted for raising and lowering with respect to boom assembly 40 on elevation assembly 46.

Screed assembly 48 includes a plow or striker 52 positioned in front of a rotational auger 50. A vibrationally isolated, vibratory screed 54 is positioned behind auger 50 with respect to the direction of movement of the screed on boom assembly 40. In addition, screed assembly 48 includes a horizontal pivot axis 56 allowing the screed assembly to be pivoted to counteract the force of concrete or other material which acts against plow 52 and which would otherwise change the position of the plow and vibratory screed and prevent effective screeding.

The elevation of screed assembly 48 is adapted to be controlled by laser guidance system 10 of the present invention. As described above and explained more fully hereinafter, laser beam receiver 16 is adjustably mounted on mast 17 secured to the top of elevation assembly 46. Receiver 16 is movable with screed assembly 48 and is adapted to receive and sense a planar laser reference beam L typically provided by a rotating laser beacon projector mounted on a tripod or other support apparatus externally of and spaced from the screeding machine 20 at a convenient location adjacent the area in which the poured concrete is being finished. The rotating laser beacon provides a reference plane of laser light relative to which the screed assembly 48 is raised and lowered to maintain and finish the poured concrete at a precise level. A tolerance range of between one-sixteenth and one-eighth of an inch is obtained when the guidance system 10 of the present invention is used.

By means of the rotatable upper frame 28, boom 40 carrying screed mounting assembly 44, screed assembly 48 and screed elevation assembly 46 may be rotated 360° around lower frame 22 for spreading, distributing, smoothing and/or leveling, i.e., screeding, the placed and/or poured, uncured concrete adjacent the machine. As explained hereinafter, boom 40 may also be rotated such that it extends rearwardly behind frame 22 and axles 24 with screed assembly 48 positioned behind the rear support wheels 26 and axle 24. In this configuration, machine 20 may be driven through placed and/or poured, uncured concrete with the smoothing and finishing operation proceeding behind the rear wheels as the apparatus moves slowly through the concrete. Any tracks are filled in as the concrete or other material is smoothed therebehind. Screeding machine 20 is also useful in the screeding of other loose, spreadable material such as sand, gravel, asphalt or other viscous, fluid materials previously placed on the ground or other support surfaces such as in parking ramps, on decks, in buildings or the like.

In use, screeding machine 20 is positioned adjacent an area of poured concrete by maneuvering the apparatus on axles 24 and wheels 26. Thereafter, stabilizing legs 25 may be lowered to firmly secure the apparatus in its desired position. Upper frame 28 is then rotated on bearing 30 to position boom 40 outwardly over the area of poured concrete and extended to position screed assembly 48 over the poured concrete at a distance spaced from the lower frame 22. Screed assembly 48 is operated by hydraulic power to rotate auger 50 while boom 40 is slowly retracted toward frame 22 such that plow or striker 52 engages the uncured concrete and levels it to an approximate height, followed by spreading of the concrete behind the plow 52 by auger 50 to fill in any open spaces in the concrete. Thereafter, the concrete is engaged by the vibratory screed 54 to smooth and finish the concrete at the desired level. At the same time, screed elevation assembly 46 is automatically raising and lowering the screed assembly to maintain the concrete at a properly finished height as guided by guidance system 10 in relation to the laser reference beam or plane as described above.

As shown in FIGS. 1 and 2, the screed elevation assembly 46 includes a screed elevation beam 58, a pair of spaced, vertically extending, cylindrical tubes 60 one at either end of beam 58. Inner screed elevation tubes 62 are slidably mounted on bearings pressed inside tubes 60. Elevation tubes 62 are moved vertically by extendable hydraulic fluid cylinders 64 mounted between flange 66 at the top of tube 62 and flange 68 at the bottom of cylinder 64 and secured to elevation beam 58. When hydraulic fluid pressure is applied to cylinder 64, the piston 70 therein is raised or lowered depending on the side of the piston against which the hydraulic fluid pressure is exerted. A spaced pair of laser beam receivers 16 and masts 17 are also mounted on flange 66 at the top end of tubes 62 and are movable with screed assembly 48 on tubes 62 as they are raised and lowered by fluid cylinders 64.

Prior to the invention of guidance system 10 of the present invention, screeding machine 20 incorporated a laser reference plane control system for automatically controlling the elevation of screed assembly 48 by means of elevation tubes 60. The prior control system included a laser receiver mounting mast 17 on each elevation tube 60 at either end of the elongated screed assembly 48 and laser beam receivers 16 removably secured to each mast 17. The rotating laser beam reference plane generated by a projector was received and detected by receivers 16 which generated electrical signals transmitted through appropriate electrical wiring passing along boom 40 to laser control electrical circuits, one being provided for each elevation tube and hydraulic cylinder 60. The control circuits were preferably mounted on upper frame 28 adjacent the operator position 38 and received and processed the electrical signals from the laser receivers 16 and transmitted electrical signals to solenoid operated hydraulic valves which were connected by appropriate hydraulic lines to fluid cylinders 64. Hydraulic fluid was pumped through appropriate lines from an internal combustion engine powered hydraulic pump to the solenoid valves and then to the fluid cylinders.

In the prior system, the solenoid operated hydraulic valves would neither raise nor lower and were, thus, not operated when the laser reference beam was centered on laser receivers 16. However, since the laser beam width of approximately one-half to three-quarters of an inch created a dead band when sensed by the receivers in their centered positions, no elevation adjustment for the screed assembly would take place within that dead band region. Accordingly, variations in finished height of the concrete being screeded of plus or minus one-half to three-quarters of an inch could occur.

In order to overcome such large tolerance range, a physical setup method was devised as shown in representative manner in FIG. 3. Thus, screeding apparatus 20 was positioned adjacent the uncured concrete to be finished with lower platform 22 artificially tilted or sloped by adjusting the extended lengths of stabilizer legs 25 at an approximate 2% angle (shown exaggerated in FIG. 3). This likewise caused telescoping boom 40 to be sloped downwardly with the screed assembly end of the boom 40 lower than the supported end at an angle of approximately 2%. As screed assembly 48 was operated and drawn toward lower frame 22 on telescoping boom 40, its position steadily rose due to the 2% slope of the boom. As a result, if the screed assembly 48 started out in centered "on target" position, it will rise above the centered position in a short distance. At such point, the solenoid operated fluid valves responsive to the laser receiver electrical controls would lower the screed assembly back to the centered "on target" position. Such pattern was repeated resulting in an amplitude of approximately one-eighth of an inch. However, such sloped positioning was very time consuming, difficult to attain and could not be accomplished when the screeding apparatus 20 was used while moving. Moreover, such artificial slope setup could not be accomplished with all types of machines using laser guidance systems.

As shown in FIGS. 1 and 2, the guidance system 10 of the present invention eliminates the need to artificially slope the screeding apparatus at a 2% angle thereby saving time in setup and allowing use of the screeding apparatus while moving through uncured concrete.

With reference to FIGS. 1 and 2, an electrically controlled hydraulic system responsive to the position of the laser reference beam L sensed by laser beam receivers 16 includes a diesel or other internal combustion engine 11. Engine 11 powers a pressure and load compensated, open loop pump 12 of the type sold by Cessna Corporation of Hutchinson, Kans. under Model No. 70423-RBT. Pump 12 includes a load sensing valve 80 and pressure compensator valve 82 as well as a load shuttle valve 84 which senses the amount and pressure of hydraulic fluid required from reservoir 13 by the open looped, closed center hydraulic system. From pump 12, hydraulic fluid under pressure as required is fed through hydraulic line 86 through adjustable flow control valve 88 which allows adjustment of the volume of hydraulic fluid flowing through line 86. Line 86 continues past flow control 88 to an electric solenoid operated, spool-type hydraulic valve assembly 14. Depending on the position of valve assembly 14 as explained hereinafter, hydraulic fluid is directed through the valves to either the bottom or top side of piston 70 in fluid cylinder 64 through lines 90, 92. When fluid is directed to the bottom of cylinder 64 through line 90, hydraulic fluid is exhausted from the top side of cylinder 64 through line 92 and returned to the hydraulic fluid reservoir 13. This causes screed assembly 48 and laser receiver 16 to be raised. Likewise, reversal of the position of valve assembly 14 causes the screed assembly 48 and laser receiver 16 to be lowered. In practice, a separate guidance system 10 is provided for each cylinder 64 at each end of screed assembly 48. However, pump 12 provides a common source of hydraulic fluid for both systems.

Also included in guidance system 10 is a laser beam receiver 16 including a pair of photosensors **16*a*, 16*b* spaced vertically from one another. Photosensors 16*a*, 16*b* sense the light energy from laser beam L and generate electrical signals proportionate to the amount of light sensed. Laser beam receiver 16 is connected by appropriate wiring to laser beam responsive electrical control circuit 18 powered by vehicle battery 19 and including low, on target, and high indicator lights 97, 98 and 100. Circuit 18 is, in turn, connected by electrical wiring to solenoids 94*c*, 96*c* of fluid valves 94, 96 in valve assembly 14** to operate those valves simultaneously as explained below.

Solenoid operated, spool-type fluid valve assembly 14 includes a pair of solenoid operated valves 94, 96 each including two sets of valve ports, **94*a*, 94*b* and 96*a*, 96*b*. Each spool valve 94, 96 is axially movable via an electric solenoid 94*c* or 96*c* under the control of laser receiver 16 and electric control circuit 18 a described hereinafter. As shown in FIG. 1, which illustrates the system when laser beam L is centered on laser receiver 16, valve 94 is normally open such that valve ports 94*b* are connected to fluid lines 90, 92 to direct hydraulic fluid into the lower end of fluid cylinder 64 and to withdraw fluid from the upper end of cylinder 64 such that piston 70 is raised. In such position, fluid valve 96 is positioned with closed 15 valve ports 96*b* connected to lines 90 and 92. In this centered "on target" position, photosensors 16*a*, 16*b* in receiver 16 generate equivalent amounts of electrical energy causing the electrical signals fed to electric circuit 18 to be balanced and equal. In such condition, electric circuit 18 provides no signal to solenoids 94*c*, 96*c* and valves 94, 96 remain in their respective normally open, normally closed positions. Simultaneously, "on target" or centered indicator light 98 in electrical circuit 18 advises the machine operator that screed assembly 48 is on target and that laser beam L is in the centered region on receiver 16**.

Since hydraulic fluid is being directed through normally open valve **94*b* to fluid cylinder 64 thereby raising the screed assembly 48 and laser beam receiver 16, laser reference beam L will eventually strike more of the lower receiver photosensor 16*b* than of the top photosensor 16*a* creating an unbalanced energy generation from the photosensors. Such signals are coupled through the electrical connections to electrical circuit 18 and indicated to the machine operator with "high" indicator light 100 being lit and "on target" light 98 being turned off. Simultaneously, sensing of the laser beam L in the high region causes electrical circuit 18 to energize solenoids 94*c*, 96*c* through appropriate electrical wiring thereby activating the solenoids and shifting spool valves 94, 96 to their opposite closed/open positions, respectively. Thus, valve ports 96*a* are connected to hydraulic lines 90, 92 to direct hydraulic fluid through line 92 into the top of fluid cylinder 64 and withdraw hydraulic fluid through line 90 from the bottom of fluid cylinder 64 causing screed assembly 48 to be lowered. Simultaneously, valve ports 94***a* are connected to lines 90, 92 and are closed. Thereafter, fluid cylinder 64 lowers screed assembly 48 until laser reference beam L is again centered on photosensors 16*a*, 16*b* when electrical circuit 18 is again switched causing deactivation of solenoids 94*c*, 96*c* and return of valves 94, 96 to their normally open/normally closed positions respectively.

As will now be understood, fluid cylinder 64 is controlled by laser receiver 16, circuit 18 and electrically operated hydraulic valves 94, 96 to raise and lower screed assembly 48 in cyclical fashion between the centered or "on target" and high regions of the laser beam on the laser beam receiver 16. As explained below, this operation significantly reduces the dead band or nonactive area caused by the width of the laser beam on the receiver 16 and significantly lowers the tolerances obtained with the controlled machine. With screeding apparatus 20, the level of the finished concrete can be controlled within a range of about one-sixteenth to one-eighth of an inch.

Preferably, laser beam receiver 16 is of the type sold under Model No. R2N by Spectra Physics Corporation of Dayton, Ohio. Laser beam responsive electrical control circuit 18 is of the type commercially sold under Model No. CB2070-D by Spectra Physics Corporation of Dayton, Ohio. Also, electrically controlled, solenoid operated spool-type hydraulic fluid valves 94, 96 are of the type sold commercially by Modular Controls Corporation of Villa Park, Ill. under Model No. SV3-10-4 and SV2-10-4. Load sensing hydraulic pump 12 may be of the type sold commercially by Cessna Corporation of Hutchinson, Kans. under Model No. 70423-RBT while flow control 88 is preferably of the type sold commercially under Model No. FDBA-HBN-GAI by Sun Corporation of Sarasota, Fla.

Although typically operated automatically as explained hereinafter, electrical circuit 18 may be switched to manual mode with manual switch 102. Switch 102 is a two position electrical switch included in wire 99 leading between solenoids 94*c*, 96*c* and is connected to an energized lead on the screeding apparatus. When the operator wishes to stop the cylinder 64 from rising in the automatic mode, he actuates manual switch 102 which energizes the solenoid 94*c* thus closing valve 94 and stopping the screed assembly from being raised and allowing valves 94, 96 to be actuated manually by the machine operator.

METHOD

As will now be understood from FIGS. 1–4, the present inventive method allows an increase in the accuracy of the controlled laser guided machine such as screeding machine 20 by more accurately controlling movable machine elements such as screeding assembly 48 relative to the laser reference plane or beam. To operate the machine and practice the present method, screeding machine 20 is positioned adjacent an area of concrete to be screeded with boom assembly 40 extended horizontally without any preset slope. Laser reference beam L is sensed with laser beam receiver 16 including photosensors 16*a*, 16*b* located on and movable with screed assembly 48. As long as laser beam L is centered on receiver 16, equivalent electrical energy signals from each photosensor are sent by electrical wire to control circuit 18 which indicates the centered region by activating indicator light 98. In such position, no electrical signal is sent to fluid valves 94, 96 and they remain in their normal positions, i.e., valve 94 being open causing fluid cylinder 64 to lift screed assembly 48 while fluid valve 96 is closed. When screed assembly 48 is lifted sufficiently, laser reference beam L will be sensed off-center in the "high" region on receiver 16, causing an imbalance in the electrical energy generated by photosensors 16*a*, 16*b* which is transmitted to circuit 18. In such condition, electrical circuit 18 generates an electrical signal which activates solenoids 94*c*, 96*c* thereby closing valve 94 and opening valve 96 and causing the screed assembly 48 to be lowered via cylinder 64. This cycle is continuously repeated as the screed assembly 48 is drawn toward the lower frame 22 of apparatus 20 such that the screed assembly 48 is continuously raised and lowered in an amplitude of approximately one-sixteenth of an inch without traversing the entire width of the laser beam or the dead band created on laser receiver 16 and without ever passing into the low range during normal operation. Hence, the dead band of prior known systems and laser control components is significantly reduced. As an example of the increase in the accuracy obtained with the guidance system and method of the present invention, assume that the screeding machine 20 shown in FIG. 3 operates with the following settings:

1. Laser system dead band (laser beam width): ±0.25 inch or 0.5 inch total.
2. Flow control 88 is set to allow cylinder 64 to move at a rate of 18.75 inches per minute.
3. Laser beam projector beacon rotates at 300 rpm causing laser receiver 16 to receive five signals per second which generate electrical energy upon reception which is transmitted to control circuit 18.
4. The opposite sides of piston 70 in cylinder 64 have equivalent areas such that similar fluid flow to either side will cause the cylinder to be raised or lowered at the same rate.

Given the above conditions and with receiver 16 initially centered on laser reference beam L, screed assembly 48 and receiver 16 begin to rise at the rate of 18.75 inches per minute. After screed assembly 48 and receiver 16 rise through the 0.25 inch dead band in 0.8 seconds (0.25 inch divided by 18.75 inches per second corresponding to four laser receiver signal pulses at one-fifth second per pulse), the signal difference in the upper and lower photosensors 16*a*, 16*b* as shown in FIG. 2 will be sufficient to cause indicator light 100 to be lit. Circuit 18 then energizes solenoids 94*c*, 96*c*, shifting valves 94, 96 to close valve 94 and open valve 96 causing cylinder 64 to lower screed assembly 48 and receiver 16. With the screed assembly and receiver being lowered at a rate of 18.75 inches per minute, they travel 0.0625 inch in the one-fifth second it takes for the next laser beam beacon signal to occur (18.75 inches per minute times one-fifth second times one minute divided by 60 seconds equals 0.0625 inch). Receiver 16 will then be within the 0.25 inch dead band and the photosensor signals will be equivalent causing circuit 18 to deenergize valves 94, 96 returning them to their open and closed positions, respectively, and causing indicator light 98 to go on and indicator light 100 to go off. In such position, cylinder 64 will again rise. By the time the next receiver signal occurs in one-fifth second, receiver 16 will have risen 0.0625 inch and the receiver photosensors 16*a*, 16*b* will cause circuit 18 indicator light 100 to come on indicating the receiver is in the "high" region and energizing solenoid valves 94, 96 to repeat the cycle. Thus, the cycle will continue to be repeated with an amplitude of 0.0625 inch (one-sixteenth of an inch). Accordingly, with the above operating settings, the accuracy of the laser system has been increased from a one-half inch dead band to a one-sixteenth inch dead band or tolerance region.

Alternate power sources and control apparatus may also be used within the scope of this invention. The improved operation obtained above can also be obtained electronically by modifying the laser responsive electrical circuit 18 to generate an electrical signal each time the laser receiver is centered with respect to the laser reference beam. In such an alternative system, valve 94 would be modified to be normally closed such that energization of the modified valve when circuit 18 receives the centered signal from receiver 16 would cause the modified valve to open and the fluid cylinder and screed assembly 48 to rise. In the high position or off-center region, control circuit 18 would generate a second signal connected to the solenoid of a valve such as that shown at 96 and deenergize the modified valve used in place of valve 94. Energization of valve 96 would cause lowering of the fluid cylinder and screed assembly as in guidance system 10 above. The modified system would continue to cycle in the same fashion as with guidance system 10.

In addition, other motive power means besides fluid cylinders could be substituted to move machine elements such as screed assembly 48. Such other power sources could include electric motors connected through cams or clutches to the machine element to be moved or internal combustion engines with cams or clutches activated in response to the control system described herein. In addition, the invention is useful with machines other than screeding apparatus such as earth movers and graders, floor cutting saws and floor sanding/finishing machines. With machines such as floor cutting saws, which typically include a circular saw blade rotating in a generally vertical plane, the laser reference plane could be positioned vertically and the saw blade moved by appropriate power sources left or right of the laser reference plane in the same manner as in the present invention. Likewise, appropriate microcomputers could be incorporated in the system to generate accurate slopes or curves which would be followed by the machine on which the system was incorporated using the edge of the laser reference plane or beam as a reference source.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by claims which follow.

The embodiments of the invention in which an exclusive property or privilege is claimed are defined as follows.

1. A guidance system for increasing the accuracy of a laser guided machine, the machine including a movable machine element positioned in response and relative to a laser reference beam located externally of the machine, said guidance system including:

laser beam receiving means mounted on and movable with the machine element for sensing the laser reference beam in a first centered region and in a second off-center region;

electrical circuit means connected electrically to said laser beam receiving means for providing a first electrical condition when the machine element and said laser beam receiving means are in said first centered region and a second electrical condition when the machine element and said laser beam receiving means are in said second off-center region;

motive power means for moving the machine element and laser beam receiving means in at least two directions between said first region and said second region; and control means for continuously operating said motive power means to move the machine element between said first and second regions, said control means being connected electrically to said electrical circuit means and mounted on the machine for operating said motive power means in response to said electrical circuit means to move said machine element in a first of said two directions from said first region to said second region when said electrical circuit means provides said first condition, and for operating said motive power means to move the machine element and said laser beam receiving means in the second of said two directions from said second region back to said first region when said electrical circuit means provides said second condition, whereby the machine element will continuously cycle between said first and second regions while reducing the dead band of said system.

2. The guidance system of claim 1 wherein said motive power means includes at least one fluid cylinder; said control means including fluid valve means for directing fluid to said fluid cylinder.

3. The guidance system of claim 2 wherein said fluid cylinder is a hydraulic cylinder; said fluid valve means including at least one solenoid operated hydraulic valve.

4. The guidance system of claim 3 wherein said fluid cylinder has a piston therein; said solenoid operated hydraulic valve including two sets of valve ports, each set having a pair of valve ports which are movable between open and closed positions, and at least one solenoid for moving said valve port sets between open and closed positions, one of said valve port sets being connected to one side of said fluid cylinder piston, the second of said valve port sets being connected to the opposite side of said fluid cylinder piston.

5. The guidance system of claim 4 wherein said one valve port set is normally open and directs hydraulic fluid to and from said fluid cylinder to move the machine element and laser beam receiving means in said first direction; said second valve port set being normally closed and preventing hydraulic fluid from being directed to and from said fluid cylinder; said control means activating said solenoid to move said valve port sets to their respective opposite closed and open positions when said electrical circuit provides said second electrical condition.

6. The guidance system of claim 5 wherein the laser guided machine is a screed, the machine element being a screed assembly for engaging, spreading and smoothing uncured concrete and like materials; the fluid cylinder being mounted to raise and lower said screed assembly; said one, normally open valve port set directing fluid to raise said screed assembly; said second, normally closed valve port set directing fluid to lower said screed assembly when opened.

7. The guidance system of claim 6 wherein said screed includes a self-contained hydraulic system including the fluid cylinder, the electrically controlled fluid valve means, a flow control for adjusting the fluid flow through the fluid valve means, and a hydraulic pump.

8. The guidance system of claim 5 including flow control means connected to said electrically controlled fluid valve means for adjusting the fluid flow through said fluid valve means.

9. The guidance system of claim 2 wherein said fluid cylinder is a hydraulic cylinder; said fluid valve means including a pair of solenoid operated hydraulic valves; said electrical circuit means including means for simultaneously activating said solenoid operated hydraulic valves to move said valves to their respective opposite positions when the machine element and laser beam receiving means are in said first and second regions.

10. The guidance system of claim 1 wherein said laser beam receiving means includes at least one photosensor which generates electrical energy when sensing a laser reference beam.

11. The guidance system of claim 10 wherein said laser beam receiving means includes a pair of said photosensors which are spaced from one another, said photosensors providing substantially equivalent electrical energy levels when in said first centered region.

12. The guidance system of claim 1 wherein said first electrical condition of said electrical circuit means provides no electrical signal to said control means; said electrical circuit means including indicator means for indicating the position of said laser beam receiving means and the machine element in said first centered region when said first electrical position is provided.

13. The guidance system of claim 12 wherein said second electrical condition of said electrical circuit means provides an electrical signal; said electrical circuit means including indicator means for indicating the position of said laser beam receiving means and the machine element in said second off-center region when said second electrical condition is provided.

14. An improved guidance system for increasing the control accuracy of a laser guided machine of the type having a machine element to be controlled and positioned with respect to a laser beam, a laser beam receiver mounted on the machine element for generating electrical signals in response to the laser beam impinging thereon, a fluid cylinder having a piston therein movable by fluid acting against opposite sides of the piston and mounted on said machine element and operable to move the machine element with respect to the laser beam, and electrically controlled fluid valve means for directing fluid to and from the fluid cylinder, and electrical control means connected to the receiver and the hydraulic valve for operating the fluid valve in response to movement of the machine element and receiver with respect to the laser beam, said improvement comprising:

said electrically controlled fluid valve means directing fluid continuously to and from said fluid cylinder to move said piston, said fluid valve means having two sets of valve ports, each set having a pair of valve ports which are movable between open and closed positions and electrical drive means for moving said valve port sets between their open and closed positions; one of said valve port sets being connected to one side of the fluid cylinder piston; the second of said valve port sets being connected to the opposite side of the fluid cylinder piston; said one valve port set being normally open and directing fluid to and from the fluid cylinder to move the machine element and laser beam receiver in one direction from a first position to a second position; said second valve port set being normally closed and preventing fluid from being directed to and from the fluid cylinder; the electrical control means including circuit means connected to said electrical drive means for moving said valve port sets to their respective opposite closed and open positions in response to the laser beam receiver and machine element reaching said second position such that said second valve port set will be open and direct fluid to and from the fluid cylinder to move the machine element and laser beam receiver in a direction opposite to said one direction from said second position back to said one position, whereby the machine element will continuously cycle between said first and second positions while reducing the dead band of the system.

15. The guidance system of claim 14 wherein said electrical drive means include at least one solenoid for shifting said valve port sets between said open and closed positions.

16. The guidance system of claim 15 wherein said fluid valve means include a pair of solenoid operated hydraulic valves; the electrical control means including electrical circuit means for simultaneously activating said solenoid operated hydraulic valves to move them to their respective opposite positions when the machine element and laser beam receiver reach said first and second positions.

17. The guidance system of claim 14 including flow control means connected to said electrically controlled fluid valve means for adjusting the fluid flow through said fluid valve means.

18. The guidance system of claim 14 wherein the laser guided machine is a screed, the machine element being a screed assembly for engaging, spreading and smoothing uncured concrete and like materials; the fluid cylinder being mounted to raise and lower said screed assembly; said one, normally open valve port set directing fluid to raise said screed assembly; said second, normally closed valve port set directing fluid to lower said screed assembly when opened.

19. The guidance system of claim 18 wherein said screed includes a self-contained hydraulic system including the fluid cylinder, the electrically controlled fluid valve means, a flow control for adjusting the fluid flow through the fluid valve means, and a hydraulic pump.

20. A method for increasing the accuracy of and controlling a laser guided machine, the machine having a movable machine element positioned in response and relative to a laser reference beam located externally of the machine, the method including:

sensing the laser reference beam with a laser beam receiver on the machine element when said laser beam receiver is in a first centered region with respect to the laser reference beam and in a second off-center region;

providing a first electrical condition with an electrical circuit means connected to the laser beam receiver on the machine when the machine element and laser beam receiver are in said first centered region and a second electrical condition with the electrical circuit means when the machine element and laser beam receiver are in said second off-center region;

controlling a motive power means to continuously move the machine element and laser beam receiver between said first and second regions, said controlling including operating the motive power means to move the machine element and laser beam receiver in a first of two directions from said first region to said second region in response to said electrical circuit means being in said first condition, and operating the motive power means to move the machine element and laser beam receiver in the second of said two directions from said second region back to said first region in response to said electrical circuit means being in said second condition;

whereby the machine element is cycled continuously between said first and second regions while reducing the dead band of the system.

21. The method of claim 20 wherein said sending of the laser reference beam includes generating electrical energy with at least one photosensor.

22. The method of claim 21 including generating electrical energy in response to the sensed laser reference beam with a pair of the photosensors, said generating including producing substantially equivalent energy levels with both photosensors when the laser beam receiver is in said first centered region and unequal energy levels when the laser beam receiver is in the second off-center region.

23. The method of claim 20 wherein said controlling includes moving the machine element and laser beam receiver in said two directions with a fluid cylinder having a piston therein and a fluid valve means positioned to direct fluid to one side of the fluid cylinder when the electrical circuit means is in said first electrical condition and the other side of the fluid cylinder when the electrical circuit means is in said second electrical condition.

24. The method of claim 23 including controlling a screed for uncured concrete and like materials including raising a screed assembly comprising the machine element and having the laser beam receiver thereon with the fluid cylinder by directing fluid to the one side of the fluid cylinder piston with the fluid valve while providing no electrical signal from the electrical circuit means in said first electrical condition, and lowering the screed assembly by directing fluid to the other side of the fluid cylinder piston with the fluid valve while providing an electrical signal from the electrical circuit means in said second electrical condition.

25. A method for increasing the accuracy of and controlling a laser guided machine having a movable machine element and a hydraulic/electrical control system, said method comprising:

sensing a laser reference beam with a laser beam receiver located on and movable with the machine element when the receiver is in a first centered region with respect to the laser reference beam and in a second off-center region with respect to the laser reference beam;

providing a first electrical condition with an electrical circuit means connected to the laser beam receiver on the machine when the machine element and laser beam receiver are in said first centered region and a second electrical condition with the electrical circuit means when the machine element and laser beam receiver are in said second off-center region;

setting an electrically operated fluid valve connected to said electrical circuit means to direct fluid continuously to and from a fluid cylinder to move the machine element and laser beam receiver between said first and second regions, said setting including positioning the fluid valve in a first position to direct fluid to the fluid cylinder to move the machine element and laser beam receiver in a first of two directions from said first centered region to said second off-center region in response to said first electrical condition, and positioning the fluid valve in a second position to direct fluid to the fluid cylinder to move the machine element and laser beam receiver in the second direction from said second to said first region in response to said second electrical condition;

whereby the machine element is cycled continuously between said first and second regions while reducing the dead band of the system.

26. The method of claim 25 including activating an electrical solenoid on said fluid valve to set the valve and cause movement of the machine element and laser beam receiver in said continuous cycle.

27. The method of claim 26 including simultaneously activating a pair of solenoid controlled fluid valves to cause movement of the machine element and laser beam receiver, said activating opening one valve while closing the other and vice versa.

28. The method of claim 25 wherein said sending of the laser reference beam includes generating electrical energy with at least one photosensor.

29. The method of claim 23 including generating electrical energy in response to the sensed laser reference beam with a pair of the photosensors, said generating including producing substantially equivalent energy levels with both photosensors when the laser beam receiver is in said first centered region and unequal energy levels when the laser beam receiver is in the second off-center region.

30. The method of claim 25 including controlling a screed for uncured concrete and like materials including raising a screed assembly comprising the machine element and having the laser beam receiver thereon with the fluid cylinder by directing fluid to the one side of the fluid cylinder piston with the fluid valve while providing no electrical signal from the electrical circuit means in said first electrical condition, and lowering the screed assembly by directing fluid to the other side of the fluid cylinder piston with the fluid valve while providing an electrical signal from the electrical circuit means in said second electrical condition.

31. A guidance system for a laser guided screeding apparatus, said apparatus including a screed for spreading and/or smoothing loose or plastic material such as uncured concrete, and elevation means for raising and lowering said screed relative to a laser reference beam located externally of said apparatus, said system comprising:

laser beam receiving means mounted on and movable with said screed for sensing the laser reference beam in a first, centered, on target region and in a second, off-center region of said receiving means;

electrical circuit means connected electrically to said laser beam receiving means for providing a first electrical condition when said screed and said laser beam receiving means are in said first on target region and a second electrical condition when said screed and said laser beam receiving means are in said second region;

said elevation means adapted to raise and lower said screed and laser beam receiving means between said first on target region and said second off-center region; and control means connected electrically to said electrical circuit means and mounted on said screed for continuously operating said elevation means to move said screed and laser beam receiving means between said first and second regions, said control means operating in response to said electrical circuit means to move said screed and laser beam receiving means from said first on target region to said second off-center region when said electrical circuit means provides said first condition, and for operating said elevation means to move said screed and said laser beam receiving means from said second off-center region back to said first on target region when said electrical circuit means provides said second condition, whereby the machine element will continuously cycle between said on target and off-center regions while reducing the dead band of said system.

32. A method for increasing the accuracy of and controlling a laser guided screeding apparatus, the screeding apparatus having a movable screed positioned in response and relative to a laser reference beam located externally of the machine, the method including:

sensing the laser reference beam with a laser beam receiver on the screed when said laser beam receiver is in a first, on target, centered region with respect to the laser reference beam and in a second or low, off-center region;

providing a first electrical condition with an electrical circuit means connected to the laser beam receiver on the screeding apparatus when the screed and laser beam receiver are in said first on target, centered region and a second electrical condition with the electrical circuit means when the screed and laser beam receiver are in said second, off-center region;

controlling an elevation means to continuously move the screed and laser beam receiver between said first on target region and said second off-center region, said controlling including operating the elevation means to move the screed and laser beam receiver from said first on target region to said second off-center region in response to said electrical circuit means being in said first condition; and operating the elevation means to move the screed and laser beam receiver from said second off-center region back to said first on target in response to the electrical circuit means being in said second condition;

whereby the screed is cycled continuously between said on target and off-center regions while reducing the dead band of the system.

33. The guidance system of claim 1 including switch means in said electrical circuit means for interrupting the continuous operation of said control means to allow manual control and operation of the machine element.

34. The guidance system of claim 14 including switch means in said electrical control means for interrupting the continuous operation of said fluid valve means to allow manual control and operation of the machine element.

35. The method of claim 20 wherein said controlling steps include manually switching said electrical circuit means to allow manual control of said motive power means and, thus, the position of the machine element.

* * * * *

UNITED STATES PATENT AND TRADEMARK OFFICE

CERTIFICATE OF CORRECTION

PATENT NO. : 4,978,246

DATED : December 18, 1990

INVENTOR(S) : Philip J. Quenzi and David W. Somero

It is certified that error appears in the above-identified patent and that said Letters Patent is hereby corrected as shown below:

Column 1, line 58:

After "METHOD," insert --now U.S. Patent No. 4,930,935, issued June 5, 1990,"

Column 4, line 61:

After "Paul J. Somero" insert --, now, U.S. Patent No. 4,930,935, issued June 5, 1990--

Column 8, line 30,

"a described" should be --as described--

Column 8, line 38:

After "closed" delete --15--

Column 15, claim 21, line 21:

"sending" should be --sensing--

Column 16, claim 28, line 31:

"sending" should be --sensing--

UNITED STATES PATENT AND TRADEMARK OFFICE

CERTIFICATE OF CORRECTION

PATENT NO. : 4,978,246

DATED : December 18, 1990

INVENTOR(S) : Philip J. Quenzi and David W. Somero

It is certified that error appears in the above-identified patent and that said Letters Patent is hereby corrected as shown below:

Column 16, claim 29, line 34:

"claim 23" should be --claim 25--

Column 17, claim 31, line 3:

After "second" insert --off center--

Column 17, claim 32, line 35:

After "second" delete --or low--

Signed and Sealed this

Eleventh Day of August, 1992

*Attest:*

DOUGLAS B. COMER

*Attesting Officer*

*Acting Commissioner of Patents and Trademarks*